US011508298B2

(12) United States Patent
Chen et al.

(10) Patent No.: US 11,508,298 B2
(45) Date of Patent: Nov. 22, 2022

(54) DISPLAY PANEL AND DRIVING METHOD THEREOF AND DISPLAY DEVICE

(71) Applicant: Beijing BOE Technology Development Co., Ltd., Beijing (CN)

(72) Inventors: Liang Chen, Beijing (CN); Lei Wang, Beijing (CN); Dongni Liu, Beijing (CN); Li Xiao, Beijing (CN); Xiaochuan Chen, Beijing (CN); Minghua Xuan, Beijing (CN); Shengji Yang, Beijing (CN); Pengcheng Lu, Beijing (CN); Detao Zhao, Beijing (CN); Ning Cong, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 485 days.

(21) Appl. No.: 16/484,983

(22) PCT Filed: Jan. 15, 2019

(86) PCT No.: PCT/CN2019/071806
§ 371 (c)(1),
(2) Date: Aug. 9, 2019

(87) PCT Pub. No.: WO2019/227946
PCT Pub. Date: Dec. 5, 2019

(65) Prior Publication Data

US 2021/0375203 A1 Dec. 2, 2021

(30) Foreign Application Priority Data

May 31, 2018 (CN) ..... 201810552445.9

(51) Int. Cl.
*G09G 3/3233* (2016.01)
*G09G 3/20* (2006.01)

(52) U.S. Cl.
CPC ..... *G09G 3/3233* (2013.01); *G09G 3/204* (2013.01); *G09G 3/2074* (2013.01); *G09G 2300/043* (2013.01)

(58) Field of Classification Search
CPC .... G09G 3/3233; G09G 3/204; G09G 3/2074; G09G 2300/043
See application file for complete search history.

(56) References Cited

U.S. PATENT DOCUMENTS 6,392,628 B1 5/2002 Yamazaki et al.
9,501,970 B2 11/2016 Park et al.
(Continued)

FOREIGN PATENT DOCUMENTS

CN 1801298 A 7/2006
CN 101127194 A 2/2008
(Continued)

OTHER PUBLICATIONS

Second Chinese Office Action dated Dec. 31, 2019.

*Primary Examiner* — Stacy Khoo
(74) *Attorney, Agent, or Firm* — Dilworth & Barrese, LLP.; Michael J. Musella, Esq.

(57) ABSTRACT

A display panel and a driving method thereof, and a display device are disclosed. The display panel includes a plurality of sub-pixel unit groups arranged in an array, the array includes a plurality of rows and a plurality of columns, each of the sub-pixel unit groups includes N sub-pixel units disposed along a column direction and a pixel driving circuit, each of the N sub-pixel units includes a light-emitting circuit, the pixel driving circuit is electrically connected to the light-emitting circuits of the N sub-pixel units, and the pixel driving circuit is configured to provide light-emitting driving currents to the light-emitting circuits of the N sub-pixel units.

18 Claims, 9 Drawing Sheets

(56) References Cited

U.S. PATENT DOCUMENTS

| | | | | |
|---|---|---|---|---|
| 10,417,958 | B2 | 9/2019 | Chung | |
| 2018/0350306 | A1* | 12/2018 | Zhang | G09G 3/3266 |
| 2018/0357956 | A1* | 12/2018 | Li | G09G 3/3233 |
| 2019/0266928 | A1* | 8/2019 | Kim | G09G 3/3233 |

FOREIGN PATENT DOCUMENTS

| | | | |
|---|---|---|---|
| CN | 105513534 | A | 4/2016 |
| CN | 105528997 | A | 4/2016 |
| CN | 207217082 | U | 4/2018 |
| CN | 108399895 | A | 8/2018 |

* cited by examiner

DISPLAY PANEL AND DRIVING METHOD THEREOF AND DISPLAY DEVICE

The present application claims priority to Chinese Patent Application No. 201810552445.9, filed on May 31, 2018, the entire disclosure of which is incorporated herein by reference as part of the present application.

TECHNICAL FIELD

Embodiments of the present disclosure relate to a display panel and a driving method thereof, and a display device.

BACKGROUND

Organic light emitting diode (OLED) display panels have gradually received wide attention due to the advantages of wide viewing angle, high contrast ratio, fast response speed and higher light-emitting brightness and lower driving voltage than inorganic light-emitting display devices. Due to the above characteristics, the organic light emitting diode (OLED) display panel can be applied to a device having a display function such as a mobile phone, a display, a notebook computer, a digital camera, an instrument, a meter, and the like.

A pixel circuit of the OLED display device usually adopts a matrix driving approach, and the matrix driving approach is categorized into an active matrix (AM) driving approach and a passive matrix (PM) driving approach according to whether a switch element is in each pixel unit. The PMOLED is of simple process and low cost, but cannot satisfy requirements of high-resolution and large-size display due to disadvantages such as crosstalk, high consumption and short lifetime. In contrast, the AMOLED integrates a set of thin film transistor and storage capacitors in the pixel circuit of each pixel, and realizes control over a current running through the OLED by controlling the driving of the thin film transistors and the storage capacitors, so as to enable the OLED to emit light as required. Compared to the PMOLED, the AMOLED requires a smaller driving current and has lower consumption and a longer lifetime, so as to be able to satisfy requirements of high resolution, multiple grayscale and large-size display. Meanwhile, the AMOLED has obvious advantages in terms of visible angle, color rendition, consumption, response time, etc., and is suitable for a high-information content and high-resolution display device.

SUMMARY

At least one embodiment of the present disclosure provides a display panel, the display panel comprises a plurality of sub-pixel unit groups arranged in an array, the array comprises a plurality of rows and a plurality of columns, each of the sub-pixel unit groups comprises N sub-pixel units disposed along a column direction and a pixel driving circuit, each of the N sub-pixel units comprises a light-emitting circuit, the pixel driving circuit is electrically connected to the light-emitting circuits of the N sub-pixel units, and the pixel driving circuit is configured to provide light-emitting driving currents to the light-emitting circuits of the N sub-pixel units; the display panel further comprises a selection circuit for each row of the sub-pixel unit groups and a light-emitting control line for each row of the sub-pixel unit groups, the selection circuit is electrically connected to the light-emitting control line and is electrically connected to the light-emitting circuits of the N sub-pixel units in the sub-pixel unit groups of a corresponding row, and the selection circuit is configured to control, under control of a light-emitting control signal provided by the light-emitting control line and a selection control signal, the light-emitting circuits of the N sub-pixel units in the sub-pixel unit groups of the corresponding row to be driven by the pixel driving circuit in a time sharing manner to emit light; and N is an integer greater than or equal to 2.

For example, in a display panel provided by an embodiment of the present disclosure, the selection circuit is electrically connected to light-emitting control terminals of the light-emitting circuits of the N sub-pixel units in the sub-pixel unit groups of the corresponding row, and the selection circuit is configured to apply in a time sharing manner the light-emitting control signal to light-emitting control terminals of the light-emitting circuits of the N sub-pixel units in the sub-pixel unit groups of the corresponding row.

For example, a display panel provided by an embodiment of the present disclosure further comprises a selection driving circuit, the selection driving circuit comprises a plurality of cascaded selection driving sub-circuits, each row of the sub-pixel unit groups is provided with one of the selection driving sub-circuits, and the selection driving sub-circuit is configured to provide the selection control signal to the selection circuit corresponding to the sub-pixel unit groups of the corresponding row.

For example, a display panel provided by an embodiment of the present disclosure further comprises a light-emitting control driving circuit, the light-emitting control driving circuit comprises a plurality of cascaded light-emitting control driving sub-circuits, each row of the sub-pixel unit groups is provided with one of the light-emitting control driving sub-circuits, the light-emitting control driving sub-circuit is electrically connected to the light-emitting control line corresponding to the sub-pixel unit groups of the corresponding row, and the light-emitting control driving sub-circuit is configured to provide the light-emitting control signal to the light-emitting control line.

For example, a display panel provided by an embodiment of the present disclosure further comprises a gate driving circuit, the gate driving circuit comprises a plurality of cascaded shift register units, each row of the sub-pixel unit groups is provided with one of the shift register units, the shift register unit is configured to provide a gate scanning signal to the pixel driving circuits in the sub-pixel unit groups of the corresponding row.

For example, in a display panel provided by an embodiment of the present disclosure, the pixel driving circuit comprises a light-emitting driving circuit, a data writing circuit, a compensating circuit, a resetting circuit, and a light-emitting control circuit; the light-emitting driving circuit comprises a driving control terminal, a first terminal and a second terminal, and the light-emitting driving circuit is configured to control a light-emitting driving current running through the first terminal and the second terminal; the data writing circuit is configured to write a data signal to the driving control terminal of the light-emitting driving circuit in response to a gate scanning signal; the compensating circuit is configured to store the written data signal and compensate the light-emitting driving circuit in response to the gate scanning signal; the resetting circuit is configured to apply a reset voltage to the driving control terminal of the light-emitting driving circuit in response to a reset signal; and the light-emitting control circuit is configured to apply a first voltage to the first terminal of the light-emitting driving circuit in response to the light-emitting control signal.

For example, in a display panel provided by an embodiment of the present disclosure, the light-emitting driving circuit comprises a first transistor, a gate electrode of the first transistor is used as the driving control terminal of the light-emitting driving circuit and is connected to a first node, a first electrode of the first transistor is used as the first terminal of the light-emitting driving circuit and is connected to a second node, and a second electrode of the first transistor is used as the second terminal of the light-emitting driving circuit and is connected to a third node; the data writing circuit comprises a second transistor, a gate electrode of the second transistor is configured to be connected to a scanning signal terminal to receive the gate scanning signal, a first electrode of the second transistor is configured to be connected to a data signal terminal to receive the data signal, and a second electrode of the second transistor is connected to the second node; the compensating circuit comprises a third transistor and a storage capacitor, a gate electrode of the third transistor is configured to be connected to the scanning signal terminal to receive the gate scanning signal, a first electrode of the third transistor is connected to the third node, a second electrode of the third transistor is connected to a first electrode of the storage capacitor, and a second electrode of the storage capacitor is configured to be connected to a first voltage terminal; the resetting circuit comprises a fourth transistor, a gate electrode of the fourth transistor is configured to be connected to a reset control terminal to receive the reset signal, and a first electrode of the fourth transistor is connected to the first node, a second electrode of the fourth transistor is configured to be connected to a reset voltage terminal to receive the reset voltage; and the light-emitting control circuit comprises a fifth transistor, a gate electrode of the fifth transistor is configured to be connected to the light-emitting control line to receive the light-emitting control signal, a first electrode of the fifth transistor is configured to be connected to the first voltage terminal to receive the first voltage, and a second electrode of the fifth transistor is connected to the second node.

For example, in a display panel provided by an embodiment of the present disclosure, N=2, two sub-pixel units in each of the sub-pixel unit groups respectively comprise a first light-emitting sub-circuit and a second light-emitting sub-circuit, the first light-emitting sub-circuit comprises a first switching circuit and a first light-emitting element, the second light-emitting sub-circuit comprises a second switching circuit and a second light-emitting element, and the first switching circuit and the second switching circuit are electrically connected to the second terminal of the light-emitting driving circuit.

For example, in a display panel provided by an embodiment of the present disclosure, the first switching circuit comprises a sixth transistor, a gate electrode of the sixth transistor is configured to receive the light-emitting control signal, and a first electrode of the sixth transistor is connected to the second terminal of the light-emitting driving circuit, a second electrode of the sixth transistor is connected to a first electrode of the first light-emitting element, and a second electrode of the first light-emitting element is connected to a second voltage terminal to receive a second voltage; and the second switching circuit comprises a seventh transistor, a gate electrode of the seventh transistor is configured to receive the light-emitting control signal, a first electrode of the seventh transistor is connected to the second terminal of the light-emitting driving circuit, a second electrode of the seventh transistor is connected to a first electrode of the second light-emitting element, and a second electrode of the second light-emitting element is connected to the second voltage terminal to receive the second voltage.

For example, in a display panel provided by an embodiment of the present disclosure, the selection circuit comprises a first selection sub-circuit and a second selection sub-circuit, the first selection sub-circuit is electrically connected to the light-emitting control line and the first switching circuit, and the second selection sub-circuit is electrically connected to the light-emitting control line and the second switching circuit.

For example, in a display panel provided by an embodiment of the present disclosure, the selection control signal comprises a first selection control signal; the first selection sub-circuit comprises an eighth transistor, a gate electrode of the eighth transistor is configured to receive the first selection control signal, a first electrode of the eighth transistor is electrically connected to the light-emitting control line, and a second electrode of the eighth transistor is electrically connected to the first switching circuit; and the second selection sub-circuit comprises a ninth transistor, a gate electrode of the ninth transistor is configured to receive the first selection control signal, a first electrode of the ninth transistor is electrically connected to the light-emitting control line, and a second electrode of the ninth transistor is electrically connected to the second switching circuit, one of the eighth transistor and the ninth transistor is a P-type transistor, and a remaining one of the eighth transistor and the ninth transistor is an N-type transistor.

For example, in a display panel provided by an embodiment of the present disclosure, the selection control signal comprises a first selection control signal and a second selection control signal; the first selection sub-circuit comprises an eighth transistor, a gate electrode of the eighth transistor is configured to receive the first selection control signal, a first electrode of the eighth transistor is electrically connected to the light-emitting control line, and a second electrode of the eighth transistor is electrically connected to the first switching circuit; and the second selection sub-circuit comprises a ninth transistor, a gate electrode of the ninth transistor is configured to receive the second selection control signal, a first electrode of the ninth transistor is electrically connected to the light-emitting control line, and a second electrode of the ninth transistor is electrically connected to the second switching circuit.

For example, in a display panel provided by an embodiment of the present disclosure, the first selection sub-circuit further comprises a tenth transistor, a gate electrode of the tenth transistor is configured to receive the second selection control signal, a first electrode of the tenth transistor is connected to the second electrode of the eighth transistor, and a second electrode of the tenth transistor is connected to a third voltage terminal to receive a third voltage; and the second selection sub-circuit further comprises an eleventh transistor, a gate electrode of the eleventh transistor is configured to receive the first selection control signal, a first electrode of the eleventh transistor is connected to the second electrode of the ninth transistor, and a second electrode of the eleventh transistor is connected to the third voltage terminal to receive the third voltage.

At least one embodiment of the present disclosure further provides a display device, and the display device comprises the display panel provided by any embodiment of the present disclosure.

At least one embodiment of the present disclosure further provides a method of driving a display panel, comprising:

dividing a frame of display scan into N sub-frames; and in the N sub-frames, causing the pixel driving circuit of each of the sub-pixel unit groups to respectively supply the light-emitting driving currents to the light-emitting circuits of the N sub-pixel units in each of the sub-pixel unit groups according to a data signal, and causing the selection circuit to control, under the control of the selection control signal and the light-emitting control signal, the light-emitting circuits of the N sub-pixel units in the sub-pixel unit groups of the corresponding row to be driven by the pixel driving circuit in the time sharing manner to emit light.

For example, in the method provided by an embodiment of the present disclosure, N=2, and the light-emitting circuits located in the sub-pixel units of an odd-numbered row and the light-emitting circuits located in the sub-pixel units of an even-numbered row emit light respectively in two different sub-frames of the N sub-frames.

BRIEF DESCRIPTION OF THE DRAWINGS

In order to demonstrate clearly technical solutions of the embodiments of the present disclosure, the accompanying drawings in relevant embodiments of the present disclosure will be introduced briefly. It is apparent that the drawings may only relate to some embodiments of the disclosure and not intended to limit the present disclosure.

DETAILED DESCRIPTION

In order to make objects, technical details and advantages of the embodiments of the disclosure apparent, the technical solutions of the embodiment will be described in a clearly and fully understandable way in connection with the drawings related to the embodiments of the disclosure. It is apparent that the described embodiments are just a part but not all of the embodiments of the disclosure. Based on the described embodiments herein, those skilled in the art can obtain other embodiment, without any creative work, which shall be within the scope of the disclosure.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present disclosure, are not intended to indicate any sequence, amount or importance, but for distinguishing various components. The terms, such as "comprise/comprising," "include/including," or the like are intended to specify that the elements or the objects stated before these terms encompass the elements or the objects and equivalents thereof listed after these terms, but not preclude other elements or objects. The terms, such as "connect/connecting/connected," "couple/coupling/coupled" or the like, are not limited to a physical connection or mechanical connection, but may include an electrical connection/coupling, directly or indirectly. The terms, "on," "under," "left," "right," or the like are only used to indicate relative position relationship, and when the position of the object which is described is changed, the relative position relationship may be changed accordingly.

The AMOLED uses thin film transistors (TFTs) to form an light-emitting driving circuit to provide a corresponding light-emitting driving current for an OLED device, for example, a low temperature polysilicon thin film transistor (LTPS TFT) or an oxide thin film transistor (Oxide TFT) is used, and compared to a general amorphous silicon thin film transistor (amorphous-Si TFT), the LTPS TFT and the Oxide TFT have characteristics of higher mobility and higher stability, therefore the LTPS TFT and Oxide TFT are more suitable for use in AMOLED display. However, non-uniformities in electrical parameters such as threshold voltage, mobility, etc., caused by the limitation of the transistor fabrication process, or the threshold voltage may drift under prolonged pressurization and high temperatures, which may cause poor display effects, for example, a mura phenomenon (uneven display brightness) or an afterimage phenomenon occurs. In view of the above problems, it is necessary to provide a pixel driving circuit for each sub-pixel unit to eliminate the non-uniformity of the transistors or the drift of the threshold voltage of the transistors to some extent.

Figure 1:
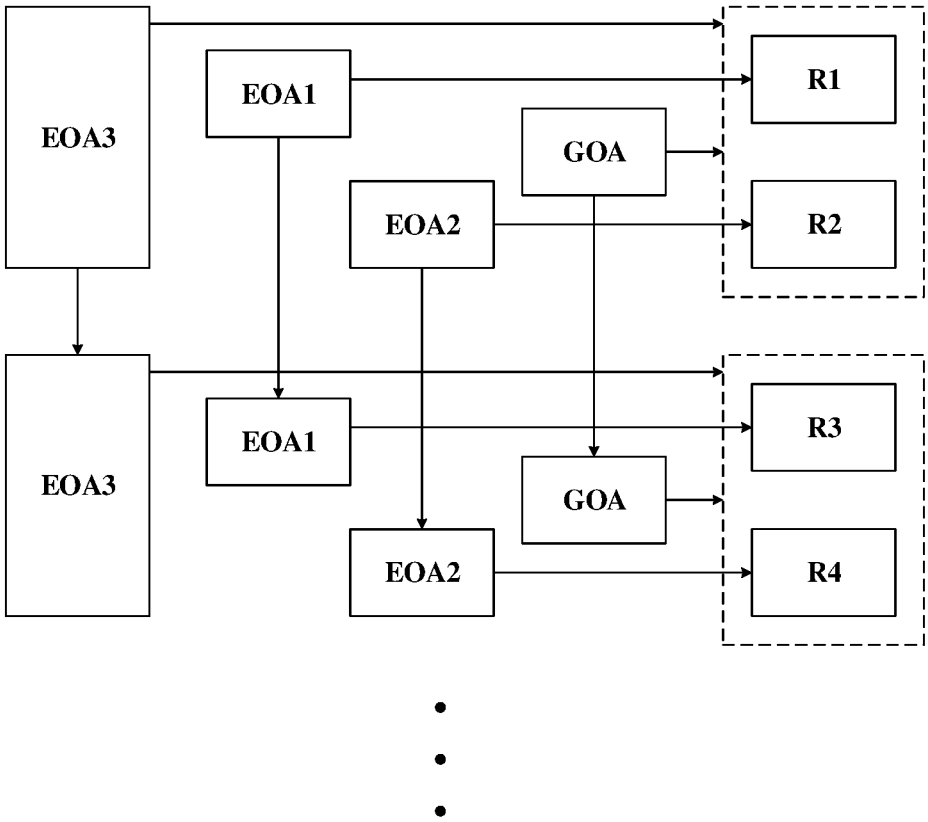
FIG. 1 is a schematic diagram of a display panel.

Setting the pixel driving circuit in each sub-pixel unit restricts the improvement of the resolution of the display panel. In a display panel that improves the resolution of the OLED display, the resolution of the display panel can be improved by reusing the pixel driving circuit. For example, as shown in FIG. 1, R1, R2, R3, and R4 represent sub-pixel units of a first row, a second row, a third row, and a fourth row in the display panel, respectively. The two sub-pixel units in a same column of the sub-pixel units of the first row and the second row can share one pixel driving circuit. Similarly, the two sub-pixel units in a same column of the sub-pixel units of the third row and the fourth row can share one pixel driving circuit, and so on, that is, a pixel driving circuit is reused between each adjacent two rows of sub-pixel units.

Figure 2:
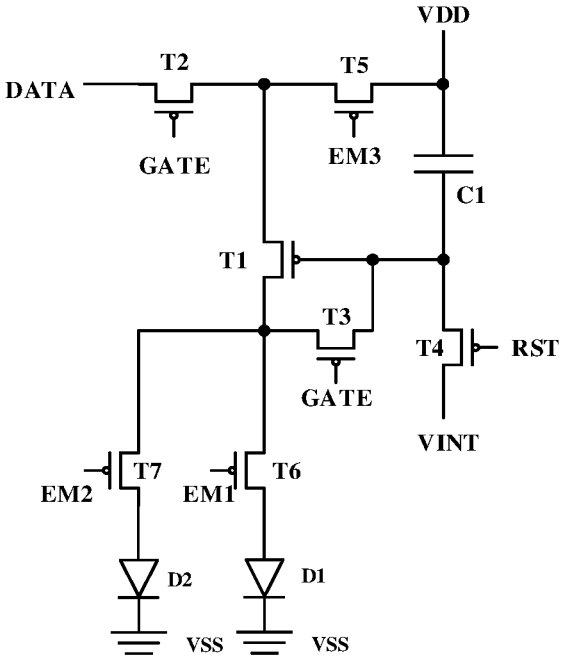
FIG. 2 is a circuit diagram of a pixel driving circuit.

For example, the above pixel driving circuit may adopt the circuit structure as shown in FIG. 2, the pixel driving circuit is composed of seven transistors (a first transistor T1 to a seventh transistor T7) and a storage capacitor C1, the first transistor T1 to the fifth transistors T5 and the storage capacitor C1 are shared by two sub-pixel units, and the sixth transistor and the seventh transistor respectively control two light-emitting elements (D1 and D2) to emit light in a time sharing manner. When the pixel driving circuit operates, in addition to providing the fifth transistor T5 with a light-emitting control signal (EM3), it is also necessary to respectively provide light-emitting control signals (EM1 and EM2) to the sixth transistor T6 and the seventh transistor T7 in different time periods (for example, in different sub-frames).

Returning back to FIG. 1, in order to provide the light-emitting control signals, three light-emitting control sub-circuits (EOA1, EOA2, and EOA3) are required to be provided for every two rows of sub-pixel units to respectively provide three light-emitting control signals (EM1, EM2, and EM3). For the circuit structure of FIG. 2, the light-emitting control driving sub-circuit EOA1 can be electrically connected to a control terminal (that is, a gate electrode) of the sixth transistor T6 to provide the light-emitting control signal EM1, and similarly, the light-emitting control driving sub-circuit EOA2 can be electrically connected to a control terminal (that is, a gate electrode) of the seventh transistor T7 to provide the light-emitting control signal EM2, and the light-emitting control driving sub-circuit EOA3 can be electrically connected to a control terminal (that is, a gate electrode) of the fifth transistor T5 to provide the light-emitting control signal EM3. As shown in FIG. 2, control terminals (that is, gate electrodes) of the second transistor T2 and the third transistor T3 are required to be connected to a scanning signal terminal GATE to receive a gate scanning signal. Accordingly, as shown in FIG. 1, every two rows of sub-pixel units are required to be provided with a shift register unit GOA, which provides the gate scanning signal to the pixel driving circuit.

In the above display panel reusing the pixel driving circuit, three light-emitting control driving sub-circuits (EOA1, EOA2, and EOA3) and one shift register unit GOA are required for every two adjacent rows of sub-pixel units, and these circuits occupy a large backplane layout space, which is not conducive to the realization of a narrow bezel, thereby limiting the resolution of the display panel.

At least one embodiment of the present disclosure provides a display panel. The display panel includes a plurality of sub-pixel unit groups arranged in an array, the array includes rows and columns, each of the sub-pixel unit groups includes N sub-pixel units disposed along a column direction and a pixel driving circuit, each of the N sub-pixel units includes a light-emitting circuit, the pixel driving circuit is electrically connected to light-emitting circuits of the N sub-pixel units, and the pixel driving circuit is configured to provide light-emitting driving currents to the light-emitting circuits of the N sub-pixel units. The display panel further includes a selection circuit and a light-emitting control line disposed for each row of the sub-pixel unit groups, the selection circuit is electrically connected to the light-emitting control line and is electrically connected to light-emitting circuits of N sub-pixel units in sub-pixel unit groups of a corresponding row, and the selection circuit is configured to, under control of a light-emitting control signal provided by the light-emitting control line and a selection control signal, control the light-emitting circuits of the N sub-pixel units in the sub-pixel unit groups of the corresponding row to be driven by the pixel driving circuit in a time sharing manner to emit light; and N is an integer greater than or equal to 2. The embodiments of the present disclosure further provide a display device and a driving method corresponding to the above display panel.

The display panel and the driving method thereof, and the display device provided by the embodiments of the present disclosure can reduce an amount of the light-emitting control driving sub-circuits in case of reusing the pixel driving circuit, which cause the bezel of the display panel to be narrower, thereby increasing the resolution of the display panel.

The embodiments of the present disclosure will be described in detail below with reference to the accompanying drawings.

Figure 3:
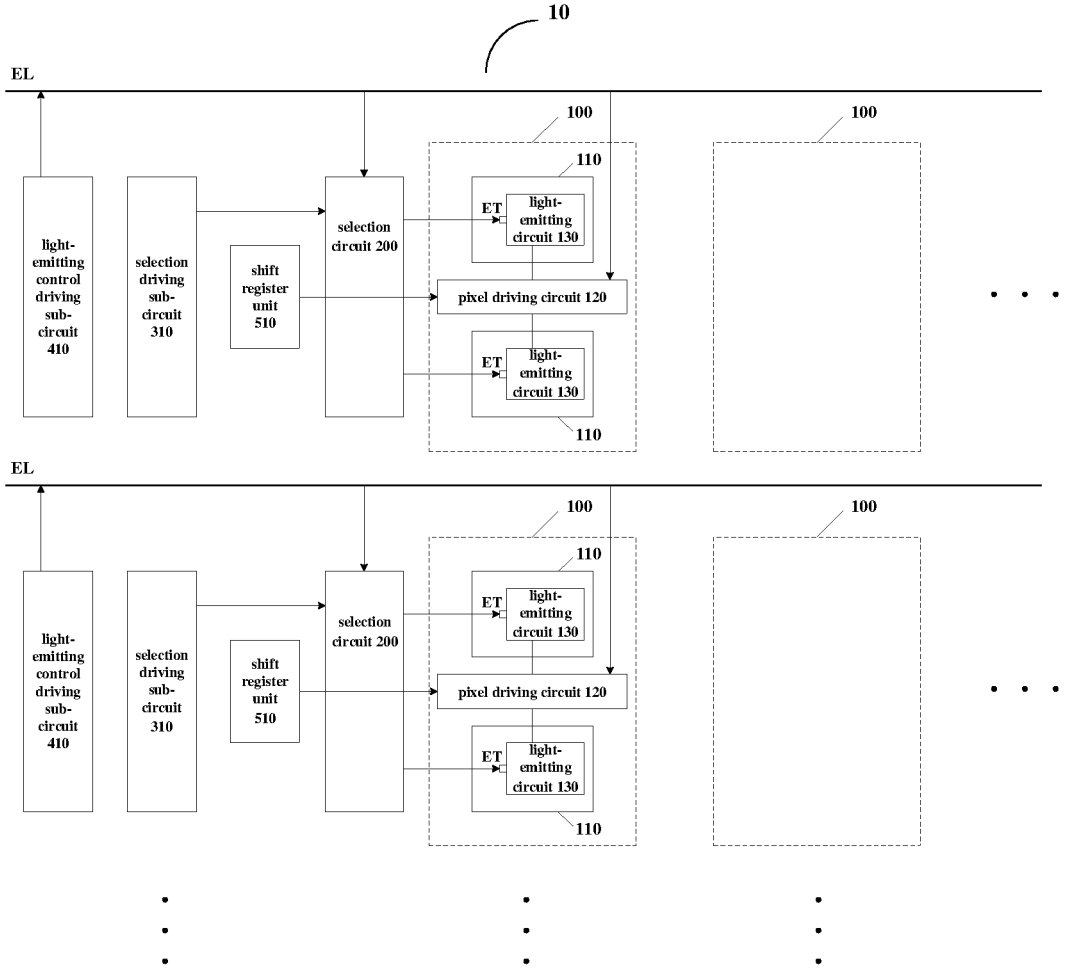
FIG. 3 is a schematic diagram of a display panel provided by some embodiments of the present disclosure.

At least one embodiment of the present disclosure provides a display panel 10. As shown in FIG. 3, the display panel 10 includes a plurality of sub-pixel unit groups 100 arranged in an array, and the array includes rows and columns. It should be noted that, FIG. 3 only schematically illustrates two rows and two columns of sub-pixel unit groups 100, the amount of the sub-pixel unit groups 100 is not limited in the embodiments of the present disclosure. For example, the amount of the sub-pixel unit groups 100 in the display panel 10 can be set according to the resolution requirements.

For example, each sub-pixel unit group 100 includes N sub-pixel units 110 disposed along a column direction and a pixel driving circuit 120, and each sub-pixel unit 110 includes a light-emitting circuit 130. The pixel driving circuit 120 is electrically connected to light-emitting circuits 130 of the N sub-pixel units 110, and the pixel driving circuit is configured to provide light-emitting driving currents to the light-emitting circuits 130 of the N sub-pixel units 110. Here, N is an integer greater than or equal to 2.

The display panel 10 further includes a selection circuit 200 and a light-emitting control line EL disposed for each row of the sub-pixel unit groups 100, the selection circuit 200 is electrically connected to the light-emitting control line EL and is electrically connected to light-emitting circuits of N sub-pixel units in sub-pixel unit groups 100 of a corresponding row, and the selection circuit is configured to, under control of a light-emitting control signal provided by the light-emitting control line and a selection control signal, control the light-emitting circuits of the N sub-pixel units in the sub-pixel unit groups of the corresponding row to be driven by the pixel driving circuit in a time sharing manner to emit light. N is an integer greater than or equal to 2.

For example, in some embodiments, as shown in FIG. 3, each sub-pixel unit group 100 includes two sub-pixel units 110 disposed in the column direction (i.e., N=2), the pixel driving circuit 120 is electrically connected to light-emitting circuits 130 in the two sub-pixel units 110, that is, two sub-pixel units 110 in each sub-pixel unit group 100 share one pixel driving circuit 120. Accordingly, the selection circuit 200 is electrically connected to light-emitting circuits 130 of two sub-pixel units 110 in sub-pixel unit groups 100 of a corresponding row. It should be noted that, FIG. 3 only illustrates that the selection circuit 200 is electrically connected to light-emitting circuits 130 in a first column of sub-pixel unit group 100 in sub-pixel unit groups 100 of a corresponding row. It is easy to understand that the selection circuit 200 is also electrically connected to light-emitting circuits 130 in other columns of sub-pixel unit groups 100 in the sub-pixel unit groups 100 of the corresponding row. In addition, the embodiments of the present disclosure do not limit the disposing position of the selection circuit 200, and the selection circuit 200 can be disposed at either end (for example, a starting end or a end) of each row of the sub-pixel unit groups 100, and the following embodiments are the same in this respect and will not be described again For example, as shown in FIG. 3, the selection circuit 200 is electrically connected to light-emitting control terminals ET of the light-emitting circuits 130 of the two sub-pixel units 110 in the sub-pixel unit groups 100 of the corresponding row, respectively, and the selection circuit 200 is configured to apply in a time sharing manner the light-emitting control signal to light-emitting control terminals ET of the light-emitting circuits 130 of the two sub-pixel units 110 in the sub-pixel unit groups 100 of the corresponding row.

For example, for the display panel 10 as shown in FIG. 3, when performing display scan, one frame of display scan can be divided into two sub-frames, for example, a first sub-frame and a second sub-frame, and the first sub-frame and the second sub-frame can be alternated in time. For example, for a first row of the sub-pixel unit groups 100, in the first sub-frame, the selection circuit 200 can apply the light-emitting control signal provided by the light-emitting control line EL to the light-emitting control terminal ET of one light-emitting circuit 130 in the sub-pixel unit group 100 under the action of the selection control signal, so that the light-emitting circuit 130 is turned on, thereby causing the pixel driving circuit 120 to be able to supply the light-emitting driving current to the light-emitting circuit 130 to emit light. Then in the second sub-frame, the selection circuit 200 can apply the light-emitting control signal provided by the light-emitting control line EL to the light-emitting control terminal ET of another light-emitting circuit 130 in the sub-pixel unit group 100 under the action of the selection control signal, so that the light-emitting circuit 130 is turned on, thereby causing the pixel driving circuit 120 to be able to supply the light-emitting driving current to the light-emitting circuit 130 to emit light. For other rows of sub-pixel unit groups 100, the selection circuit 200 controls the light-emitting circuits 130 in a same manner as described above, and details are not described herein again.

For example, by the above arrangement, it is possible to cause the sub-pixel units 110 located in the first row of the display panel 10 to display by emitting light in the first sub-frame, cause the sub-pixel units 110 located in the second row of the display panel 10 to perform display by emitting light in the second sub-frame, causes the sub-pixel units 110 located in the third row of the display panel 10 to display by emitting light in the first sub-frame, and then cause the sub-pixel units 110 located in the fourth row of the display panel 10 to display by emitting light in the second sub-frame, and so on. That is, it is possible to realize that the sub-pixel units 110 located in the odd-numbered row of the display panel 10 display by emitting light in the first sub-frame, and the sub-pixel units 110 located in the even-numbered row of the display panel 10 display in the second sub-frame in the second sub-frame, thereby completing display scanning for one frame.

Figure 4:
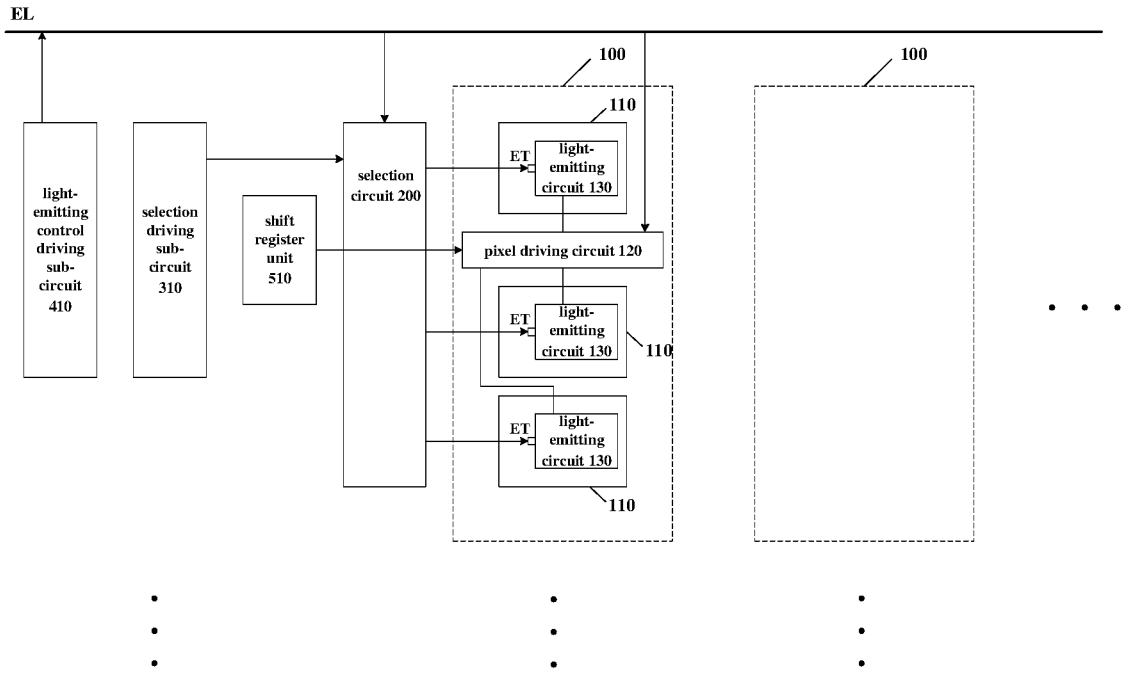
FIG. 4 is a schematic diagram of another display panel provided by some embodiments of the present disclosure.

For example, in some embodiments, as shown in FIG. 4 (only schematically shows one row of sub-pixel unit groups 100), each sub-pixel unit group 100 includes three sub-pixel units 110 disposed in the column direction (i.e., N=3), the pixel driving circuit 120 is electrically connected to light-emitting circuits 130 in the three sub-pixel units 110, that is, three sub-pixel units 110 in each sub-pixel unit group 100 share one pixel driving circuit 120. Accordingly, the selection circuit 200 is electrically connected to light-emitting circuits 130 of three sub-pixel units 110 in sub-pixel unit groups 100 of a corresponding row.

For example, as shown in FIG. 4, the selection circuit 200 is electrically connected to light-emitting control terminals ET of the light-emitting circuits 130 of the three sub pixel units 110 in the sub-pixel unit groups 100 of the corresponding row, respectively, and the selection circuit 200 is configured to apply in a time sharing manner the light-emitting control signal to light-emitting control terminals ET of the light-emitting circuits 130 of the three sub-pixel units 110 in the sub-pixel unit groups 100 of the corresponding row.

For example, for the display panel 10 as shown in FIG. 4, when performing display scan, one frame of display scan can be divided into three sub-frames, for example, a first sub-frame, a second sub-frame and a third sub-frame, and the first sub-frame, the second sub-frame, and the third sub-frame can be alternated in time. For example, for the first row of the sub-pixel unit groups 100, in the first sub-frame, the second sub-frame and the third sub-frame, the selection circuit 200 can apply the light-emitting control signal provided by the light-emitting control line EL to light-emitting control terminals ET of three light-emitting circuits 130 in the sub-pixel unit group 100 under the action of the selection control signal, so that the corresponding light-emitting circuit 130 is turned on, thereby causing the pixel driving circuit 120 to be able to supply the light-emitting driving current to the turned-on light-emitting circuits 130 to emit light. For other rows of sub-pixel unit groups 100, the selection circuit 200 controls the light-emitting circuits 130 in a same manner as described above, and details are not described herein again. For example, by the above arrangement, it is possible to cause the sub-pixel units 110 located in a (3n-2)th row of the display panel 10 to display by emitting light in the first sub-frame, cause the sub-pixel units 110 located in a (3n-1)th row of the display panel 10 to display by emitting light in the second sub-frame, and cause the sub-pixel units 110 located in a (3n)th row of the display panel 10 to display by emitting light in the third sub-frame, thereby completing display scanning for one frame. n is an integer greater than zero.

It should be noted that FIG. 3 and FIG. 4 only schematically show some embodiments in which N=2 and N=3, but the embodiments of the present disclosure do not limit the value of N, and N only needs to be an integer greater than or equal to 2. For example, in the embodiments of the present disclosure, each sub-pixel unit group 100 can also include four, five, or more sub-pixel units 110.

The display panel provided by the embodiment of the present disclosure can provide the light-emitting control signal for a plurality of light-emitting circuits in the sub-pixel unit group in a time sharing manner by reusing the pixel driving circuit and providing the selection circuit, so that the plurality of light-emitting circuits can emit light during different sub-frames, and thus in a case where the amount of the pixel driving circuits provided in the display panel is unchanged, more sub-pixel units can be provided corresponding to each pixel driving circuit unit, which can increase the resolution of the display panel.

It should be noted that, in the embodiments of the present disclosure, the selection circuit can be disposed for each row of sub-pixel unit groups in the display panel, thereby increasing the resolution of the entire region of the display panel. The embodiments of the present disclosure include but are not limited thereto, for example, it is also possible to provide the selection circuit only for the sub-pixel unit groups in a part of the display panel, so that only the resolution of the part can be increased.

Figure 5:
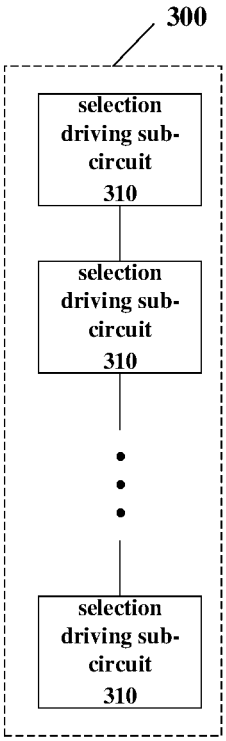
FIG. 5 is a schematic diagram of a selection driving circuit provided by some embodiments of the present disclosure.

For example, the display panel 10 provided by the embodiment of the present disclosure further includes a selection driving circuit 300. As shown in FIG. 5, the selection driving circuit includes a plurality of cascaded selection driving sub-circuits 310. As shown in FIG. 3 and FIG. 4, each row of the sub-pixel unit groups 100 is correspondingly provided with one selection driving sub-circuit 310, and the selection driving sub-circuit 310 is configured to provide the selection control signal to a selection circuit 200 corresponding to the sub-pixel unit groups 100 of the corresponding row. For example, the selection control signals provided by two cascaded selection driving sub-circuits 310 are offset from one another by a fixed time interval.

Figure 6:
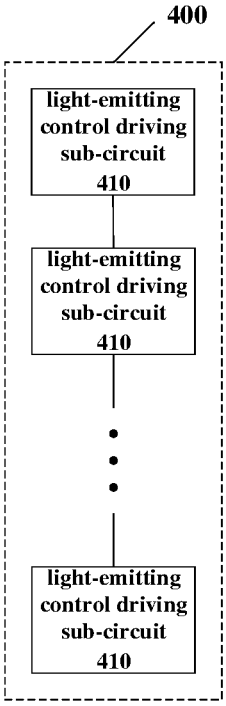
FIG. 6 is a schematic diagram of a light-emitting control driving circuit provided by some embodiments of the present disclosure.

For example, the display panel 10 provided by the embodiments of the present disclosure further includes a light-emitting control driving circuit 400. As shown in FIG. 6, the light-emitting control driving circuit 400 includes a plurality of cascaded light-emitting control driving sub-circuits 410. As shown in FIG. 3 and FIG. 4, each row of the sub-pixel unit groups 100 is provided with the light-emitting control driving sub-circuit 410. The light-emitting control driving sub-circuit 410 is electrically connected to a light-emitting control line EL corresponding to the sub-pixel unit groups 100 of the corresponding row, and is configured to provide the light-emitting control signal to the light-emitting control line EL. For example, the light-emitting control signal transmitted through the light-emitting control line EL is supplied to the pixel driving circuit 120 in each row of the sub pixel unit groups 100 in addition to being supplied to the selection circuit 200, for example, the light-emitting control signal is used to turn on TFTs in the pixel driving circuit 120 in a light-emitting stage.

In the display panel provided by the embodiments of the present disclosure, each row of the sub-pixel unit group is only required to be correspondingly provided with one light-emitting control driving sub-circuit 410, which can further reduce the bezel width of the display panel, thereby further improving the resolution of the display panel.

Figure 7:
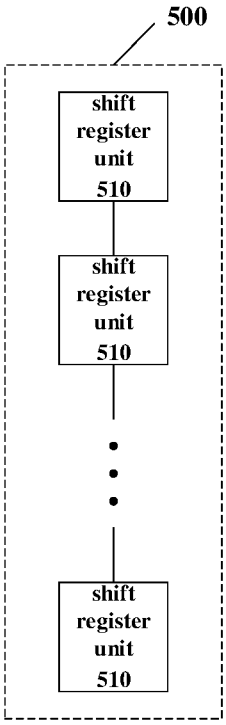
FIG. 7 is a schematic diagram of a gate driving circuit provided by some embodiments of the present disclosure.

For example, the display panel 10 provided by the embodiments of the present disclosure further includes a gate driving circuit 500, and as shown in FIG. 7, the gate driving circuit 500 includes a plurality of cascaded shift register units 510. As shown in FIG. 3 and FIG. 4, each row of the sub-pixel unit groups 100 is provided with one shift register unit 510, and the shift register unit 510 is configured to provide a gate scanning signal to pixel driving circuits 120 in the sub-pixel unit groups 100 of the corresponding row. The gate scanning signals provided by the cascaded shift register units 510 are shifted stage by stage, so that the rows of sub-pixel unit groups of the display panel can display by emitting light row by row. It should be noted that, the gate driving circuit 500 in the embodiment of the present disclosure can adopt a conventional design as long as it can provide the gate scanning signal that is shifted stage by stage.

Figure 8:
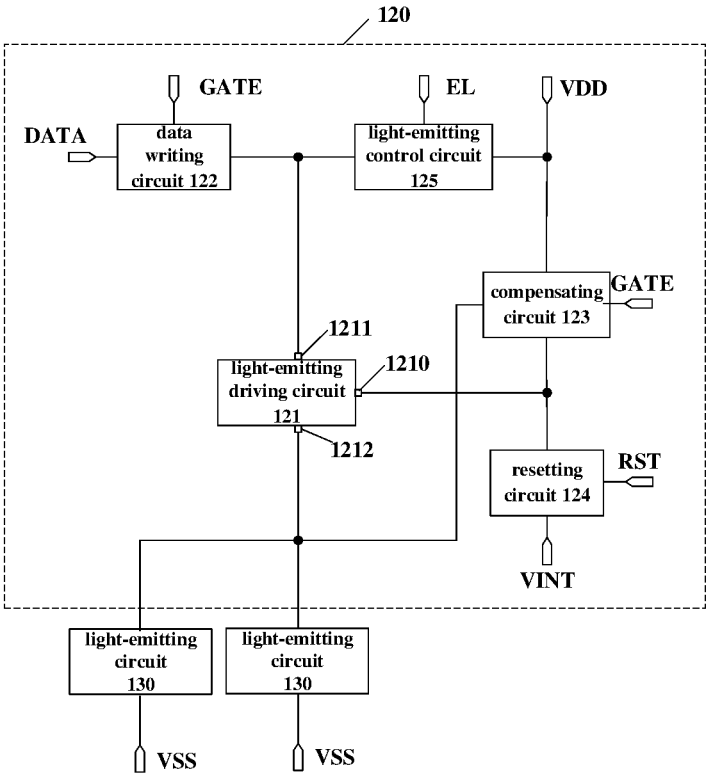
FIG. 8 is a schematic block diagram of a pixel driving circuit provided by some embodiments of the present disclosure.

In the embodiment of the present disclosure, the pixel driving circuit 120 is a pixel driving circuit with a compensating function. The compensating function can be implemented by voltage compensating, current compensating or hybrid compensating. The pixel driving circuit with the compensating function can be, for example, of a 4T1C or 4T2C structure. In some embodiments of the present disclosure, as illustrated in FIG. 8, the pixel driving circuit 120 includes a light-emitting driving circuit 121, a data writing circuit 122, a compensating circuit 123, a resetting circuit 124, and a light-emitting control circuit 125.

The light-emitting driving circuit 121 includes a driving control terminal 1210, a first terminal 1211, and a second terminal 1212, and is configured to control the light-emitting driving current flowing through the first terminal 1211 and the second terminal 1212. For example, in the light-emitting stage, the light-emitting driving circuit 121 can supply the light-emitting driving current to a light-emitting element in the light-emitting circuit 130 to drive the light-emitting element to emit light, and the light-emitting element can emit light according to a desired "grayscale".

The data writing circuit 122 is configured to write a data signal to the driving control terminal 1210 of the light-emitting driving circuit 121 in response to the gate scanning signal. For example, the data writing circuit 122 is connected to a scanning signal terminal GATE and a data signal terminal DATA. For example, in a data writing and compensating stage, the data writing circuit 122 is turned on in response to the gate scanning signal input by the scanning signal terminal GATE, so that the data signal input by the data signal terminal DATA is written into the driving control terminal 1210 of the light-emitting driving circuit 121 and stored in the compensating circuit 123, thereby generating the light-emitting driving current for driving the light-emitting circuit 130 to emit light according to the data signal, for example, in the light-emitting stage.

The compensating circuit 123 is configured to store the written data signal and compensate the light-emitting driving circuit 121 in response to the gate scanning signal. For example, in a case where the compensating circuit 123 includes a storage capacitor, for example, in the data writing and compensating stage, the compensating circuit 123 can be turned on in response to the gate scanning signal input by the scanning signal terminal GATE, so that the data signal written by the data writing circuit 122 is stored in the storage capacitor. For example, during the data writing and compensating stage, the compensating circuit 123 can electrically connect the driving control terminal 1210 of the light-emitting driving circuit 121 and the second terminal 1212 of the light-emitting driving circuit 121, thereby correspondingly storing relevant information of a threshold voltage of the light-emitting driving circuit 121 in the storage capacitor, and thus for example, in the light-emitting stage, the light-emitting driving circuit 121 can be controlled with the stored data signal and the threshold voltage to compensate the light-emitting driving circuit 121.

The resetting circuit 124 is configured to apply a reset voltage to the driving control terminal 1210 of the light-emitting driving circuit 121 in response to a reset signal. For example, the resetting circuit 124 is connected to a reset control terminal RST and a reset voltage terminal VINT, for example, in a resetting stage, the resetting circuit 124 can be turned on in response to the reset signal inputted by the reset control terminal RST, thereby applying the reset voltage inputted by the reset voltage terminal VINT to the driving control terminal 1210 of the light-emitting driving circuit 121. It should be noted that, in some embodiments of the present disclosure, the resetting circuit 124 of the pixel driving circuit 120 in the sub-pixel unit group 100 of the row may not be connected to the reset control terminal RST, but be connected to scanning signal terminal GATE of the pixel driving circuit 120 in the sub-pixel unit group 100 of a previous row, that is, the gate scanning signal corresponding to the previous row of the sub-pixel unit groups 100 is used as the reset signal. The embodiments of the present disclosure do not limit the manner in which the reset signal is applied.

The light-emitting control circuit 125 is configured to apply a first voltage to the first terminal 1211 of the light-emitting driving circuit 121 in response to the light-emitting control signal. For example, the light-emitting control circuit 125 is electrically connected to the light-emitting control line EL so as to receive the light-emitting control signal provided by the light-emitting control line EL, and the light-emitting control circuit 125 is further connected to a first voltage terminal VDD to receive the first voltage. For example, in the light-emitting stage, the light-emitting control circuit 125 is turned on in response to the light-emitting control signal, so that the first voltage can be applied to the first terminal 1211 of the light-emitting driving circuit 121. It is easy to understand that when the light-emitting driving circuit 121 is turned on, a potential of the second terminal 1212 is also the first voltage. Then, the light-emitting driving circuit 121 applies this first voltage to the light-emitting element in the light-emitting circuit 130 to supply a driving voltage, thereby driving the light-emitting element to emit light. For example, the first voltage can be a driving voltage, such as a high voltage.

As described above, the pixel driving circuit 120 provided by the embodiments of the present disclosure is not limited to the example in FIG. 8, and the pixel driving circuit 120 can also employ other conventional pixel driving circuits as long as the function described in the embodiment of the present disclosure can be implemented accordingly.

In FIG. 8, the light-emitting circuit 130 is connected between the pixel driving circuit 120 and a second voltage terminal VSS, and a voltage input terminal of the pixel driving circuit 120 is connected to the first voltage terminal VDD, thereby driving the light-emitting circuit 130 to emit light. Corresponding to this, in other examples, the light-emitting circuit 130 can be connected between the pixel driving circuit 120 and the first voltage terminal VDD, and the voltage input terminal of the pixel driving circuit 120 is connected to the second voltage terminal VSS, thereby driving the light-emitting circuit 130 to emit light.

Figure 10:
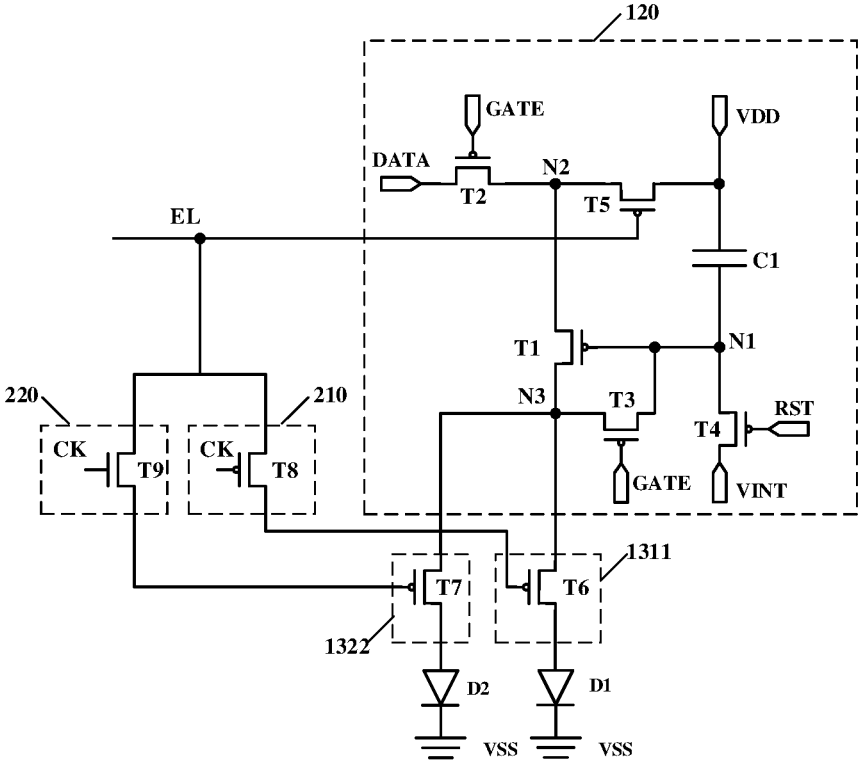
FIG. 10 is a circuit diagram of an implementation example of a pixel driving circuit, a selection circuit and a light-emitting circuit in a display panel provided by some embodiments of the present disclosure.

For example, in some embodiments, the pixel driving circuit 120 as shown in FIG. 8 can be implemented as the circuit structure as shown in FIG. 10. As shown in FIG. 10, the pixel driving circuit 120 include a first transistor to a fifth transistor T1, T2, T3, T4, T5 and a storage capacitor C1. For example, the first transistor T1 is used as a driving transistor, and the other second to fifth transistors are used as switching transistors.

For example, as shown in FIG. 10, in more detail, the light-emitting driving circuit 121 can be implemented as the first transistor T1. A gate electrode of the first transistor T1 is used as the driving control terminal 1210 of the light-emitting driving circuit 121 and is connected to a first node N1, a first electrode of the first transistor T1 is used as the first terminal 1211 of the light-emitting driving circuit 121 and is connected to a second node N2, and a second electrode of the first transistor T1 is used as the second terminal 1212 of the light-emitting driving circuit 121 and is connected to a third node N3.

The data writing circuit 122 can be implemented as a second transistor T2. A gate electrode of the second transistor T2 is configured to be connected to the scanning signal terminal GATE to receive the gate scanning signal, a first electrode of the second transistor T2 is configured to be connected to the data signal terminal DATA to receive the data signal, and a second electrode of the second transistor T2 is connected to the second node N2.

The compensating circuit 123 can be implemented to include a third transistor T3 and the storage capacitor C1. A gate electrode of the third transistor T3 is configured to be connected to the scanning signal terminal GATE to receive the gate scanning signal, a first electrode of the third transistor T3 is connected to the third node N3, a second electrode of the third transistor T3 is connected to a first electrode of the storage capacitor C1 (that is, connected to the first node N1), and a second electrode of the storage capacitor C1 is configured to be connected to the first voltage terminal VDD to receive the first voltage.

The resetting circuit 124 can be implemented as a fourth transistor T4. A gate electrode of the fourth transistor T4 is configured to be connected to the reset control terminal RST to receive the reset signal, and a first electrode of the fourth transistor T4 is connected to the first node N1, a second electrode of the fourth transistor T4 is configured to be connected to the reset voltage terminal VINT to receive the reset voltage. It should be noted that, in a case where the reset voltage terminal VINT is not provided, the gate electrode of the fourth transistor T4 can be connected to the scanning signal terminal GATE of the pixel driving circuit 120 in the previous row of sub-pixel unit groups 100, that is, the gate scanning signal of the previous row of sub-pixel unit groups 100 can be used as the reset signal. The embodiments of the present disclosure do not limit the manner in which the reset signal is applied.

The light-emitting control circuit 125 can be implemented as a fifth transistor T5. A gate electrode of the fifth transistor T5 is configured to be connected to the light-emitting control line EL to receive the light-emitting control signal, a first electrode of the fifth transistor T5 is configured to be connected to the first voltage terminal VDD to receive the first voltage, and a second electrode of the fifth transistor T5 is connected to the second node N2.

Figure 9:
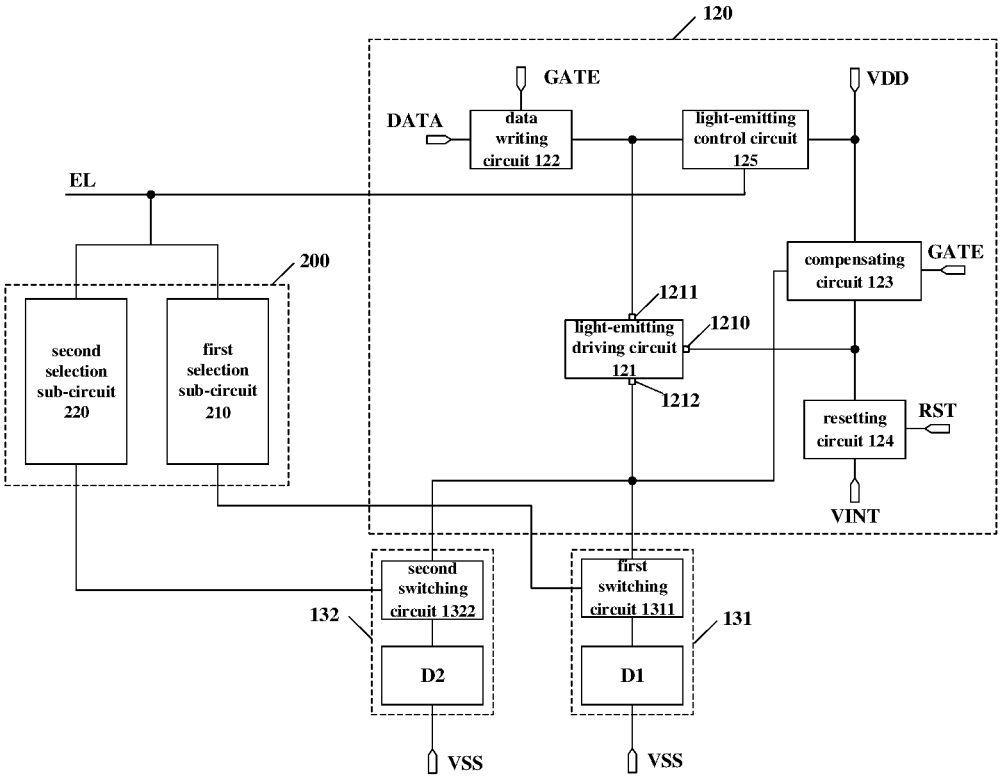
FIG. 9 is a schematic block diagram of a selection circuit provided by some embodiments of the present disclosure.

In some embodiments of the present disclosure, for example, N=2, that is, each sub-pixel unit group 100 includes two sub-pixel units 110. As shown in FIG. 9, in a sub-pixel unit group 100, for clarity of description, light-emitting circuits 130 included in the two sub-pixel units 110 in the sub-pixel unit group 100 are referred as a first light-emitting sub-circuit 131 and a second light-emitting sub-circuit 132. The first light-emitting sub-circuit 131 includes a first switching circuit 1311 and a first light-emitting element D1, the second light-emitting sub-circuit 132 includes a second switching circuit 1322 and a second light-emitting element D2, and the first switching circuit 1311 and the second switching circuit 1322 are electrically connected to the second terminal 1212 of the light-emitting driving circuit 121.

The light-emitting elements (for example, the first light-emitting element D1 and the second light-emitting element D2) in the embodiments of the present disclosure can adopt OLED, the embodiments of the present disclosure include but are not limited thereto, the following embodiments take the OLED as an example for description, and details are not described here again. The OLED can be of various types, such as a top emission type, a bottom emission type, or the like, and can emit red, green, blue, or white light, etc., which is not limited by the embodiments of the present disclosure.

For example, in some embodiments of the present disclosure, as shown in FIG. 10, the first switching circuit 1311 can be implemented as a sixth transistor T6. A gate electrode of the sixth transistor T6 is configured to receive the light-emitting control signal, for example, the gate electrode of the sixth transistor T6 is connected to the selection circuit, thereby receiving the light-emitting control signal provided by the light-emitting control line EL when the selection circuit is turned on. A first electrode of the sixth transistor T6 is connected to the second terminal 1212 of the light-emitting driving circuit 121 (that is, connected to the third node N3), a second electrode of the sixth transistor T6 is connected to a first electrode (that is, an anode) of the first light-emitting element D1, and a second electrode (that is, a cathode) of the first light-emitting element D1 is connected to the second voltage terminal VSS to receive the second voltage. For example, the second voltage terminal VSS can be grounded, that is, the second voltage is 0V.

As shown in FIG. 10, the second switching circuit 1322 can be implemented as a seventh transistor T7. A gate electrode of the seventh transistor T7 is configured to receive the light-emitting control signal, for example, the gate electrode of the seventh transistor T7 is connected to the selection circuit, thereby receiving the light-emitting control signal provided by the light-emitting control line EL when the selection circuit is turned on. A first electrode of the seventh transistor T7 is connected to the second terminal of the light-emitting driving circuit 121 (for example, connected to the three node N3), a second electrode of the seventh transistor T7 is connected to a first electrode (that is, an anode) of the second light-emitting element D2, and a second electrode (that is, a cathode) of the second light-emitting element D2 is connected to the second voltage terminal VSS to receive the second voltage.

In some embodiments, as shown in FIG. 9, the selection circuit 200 includes a first selection sub-circuit 210 and a second selection sub-circuit 220. The first selection sub-circuit 210 is electrically connected to the light-emitting control line EL and the first switching circuit 1311 to supply the light-emitting control signal provided by the light-emitting control line EL to the first switching circuit 1311 when the first selection sub-circuit 210 is turned on, thereby causing the first switching circuit 1311 to be turned on, and causing the pixel driving circuit 120 to provide the light-emitting driving current to the first light-emitting element D1. The second selection sub-circuit 220 is electrically connected to the light-emitting control line EL and the second switching circuit 1322 to supply the light-emitting control signal provided by the light-emitting control line EL to the second switching circuit 1322 when the second selection sub-circuit 220 is turned on, thereby causing the second switching circuit 1322 to be turned on, and causing the pixel driving circuit 120 to provide the light-emitting driving current to the second light-emitting element D2.

For example, in some embodiments, as shown in FIG. 10, the first selection sub-circuit 210 can be implemented as an eighth transistor T8, a gate electrode of the eighth transistor T8 is configured to receive a first selection control signal CK, a first electrode of the eight transistor T8 is electrically connected to the light-emitting control line EL to receive the light-emitting control signal, and a second electrode of the eighth transistor T8 is electrically connected to the first switching circuit 1311, for example, in a case where the first switching circuit 1311 is implemented as the sixth transistor, the second electrode of the eighth transistor T8 is connected to the gate electrode of the sixth transistor T6. For example, the eighth transistor T8 is a P-type Transistor.

The second selection sub-circuit 220 can be implemented as a ninth transistor T9, a gate electrode of the ninth transistor T9 is configured to receive the first selection control signal CK, a first electrode of the ninth transistor T9 is electrically connected to the light-emitting control line EL to receive the light-emitting control signal, and a second electrode of the ninth transistor T9 is electrically connected to the second switching circuit 1322, for example, in a case where the second switching circuit 1322 is implemented as the seventh transistor T7, the second electrode of the ninth transistor T9 is connected to the gate electrode of the seventh transistor T7. For example, the ninth transistor T9 is an N-type transistor.

It should be noted that the transistors in the embodiments of the present disclosure can adopt thin film transistors, field-effect transistors or other switching devices with the same characteristics. In the embodiments of the present disclosure, thin film transistors are adopted as an example for description. Source electrodes and drain electrodes of the transistors adopted herein can be symmetrical in structure, so that the source electrodes and drain electrodes are not different in structure. In the embodiments of the present disclosure, in order to distinguish the two electrodes of a transistor other than a gate electrode, one of the two electrodes is referred to as a first electrode and the other electrode is referred to as a second electrode. In addition, the transistors can be divided into N-type transistors or P-type transistors according to characteristics of the transistors. In a case where a transistor is a P-type transistor, a turn-on voltage of the transistor is a low-level voltage (for example, 0V, −5V, −10V or other appropriate voltage), and a turn-off voltage of the transistor is a high-level voltage (for example, 5V, 10V, or other appropriate voltage). In a case where a transistor is an N-type transistor, a turn-on voltage of the transistor is a high-level voltage (for example, 5V, 10V, or other appropriate voltage), and a turn-off voltage of the transistor is a low-level voltage (for example, 0V, −5V, −10V or other appropriate voltage).

In addition, it should be noted that the transistors adopted in the pixel driving circuit 120 provided in the embodiments of the present disclosure are all described by taking P-type transistors as an example. The embodiments of the present disclosure include but are not limited thereto, for example, part or all of the transistors in the pixel driving circuit 120 can also adopt N-type transistors.

Figure 12A:
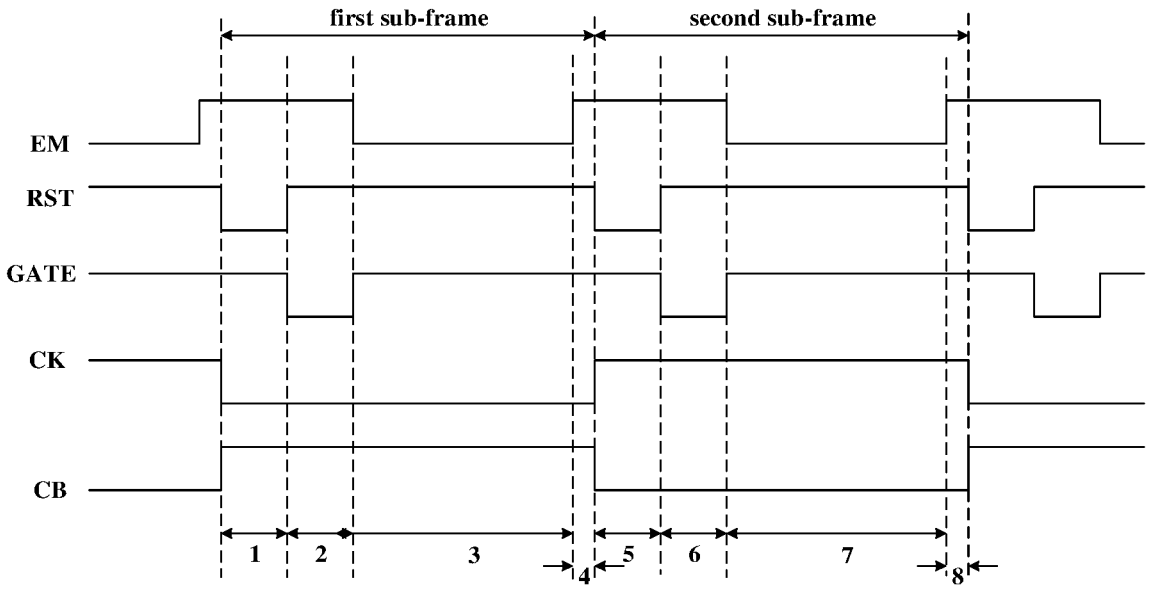
FIG. 12A is a signal timing diagram corresponding to FIG. 10 and FIG. 11.

The operation principle of the circuit structure as shown in FIG. 10 is described below in conjunction with a signal timing diagram as shown in FIG. 12A. For example, as shown in FIG. 12A, a frame of display scan is divided into a first sub-frame and a second sub-frame. FIG. 12A shows a timing of signals provided by respective signal terminals of the pixel driving circuit 120 as shown in FIG. 10 and a timing of the selection control signal controlling the selection circuit 200, for example, the first light-emitting element D1 is driven to emit light in the first sub-frame, and the second light-emitting element D2 is driven to emit light in the second sub-frame.

In the first sub-frame, because the first selection control signal CK is always kept at a low level, the eighth transistor T8 (P-type transistor) keeps being turned on in the first sub-frame, and the ninth transistor T9 (N-type transistor) keeps being turned off.

In a resetting stage 1, the reset control terminal RST is input with a low-level signal, the fourth transistor T4 is turned on to apply the reset voltage input by the reset voltage terminal VINT to the gate electrode of the first transistor T1, thereby resetting the first transistor T1.

In a data writing and compensating stage 2, the scanning signal terminal GATE is input with a low-level signal, the second transistor T2 and the third transistor T3 are turned on, and the first transistor T1 keeps being turned on due to being reset in the previous stage, and thus the data signal input by the data signal terminal DATA charges the storage capacitor C1 through the second transistor T2, the first transistor T1 and the third transistor T3, and the charging process is ended until the first transistor T1 is turned off. After the data writing and compensating stage 2, information including the data signal and the threshold voltage of the first transistor T1 can be stored in the storage capacitor C1 in order to provide grayscale display data and compensate the threshold voltage of the first transistor T1 in a subsequent light-emitting stage.

In the light-emitting stage 3, the light-emitting control signal provided by the light-emitting control line EL is a low-level signal. Because the eighth transistor T8 keeps being turned on in the first sub-frame, the low-level signal is applied to the gate electrode of the sixth transistor T6 through the eighth transistor T8, thereby causing the sixth transistor T6 to be turned on, and causing the fifth transistor T5 to be turned on. The first voltage input by the first voltage terminal VDD can be applied to the first light-emitting element D1 through the fifth transistor T5, the first transistor T1, and the sixth transistor T6, thereby causing the first transistor T1 to provide the light-emitting driving current that causes the first light-emitting element D1 to emit light according to the first voltage and the data signal.

In a turning off stage 4, the light-emitting control signal provided by the light-emitting control line EL is changed to be a high-level signal. Because the eighth transistor T8 keeps being turned on in the first sub-frame, the high-level signal is applied to the gate electrode of the sixth transistor T6 through the eighth transistor T8, thereby causing the sixth transistor T6 to be turned on. In this stage, the sixth transistor T6 is turned off to prevent the first light-emitting element D1 from emitting light in the second sub-frame, thereby avoiding the occurrence of poor display.

In the second sub-frame, because the first selection control signal CK is kept at a high level, the ninth transistor T9 keeps being turned on and the eighth transistor T8 keeps being turned off in the second sub-frame. For the descriptions of the resetting stage 5, the data writing and compensating stage 6, the light-emitting stage 7 and the turning off stage 8 in the second sub-frame, reference can be made respectively to corresponding descriptions of the resetting stage 1, the data writing and compensating stage 2, the light-emitting stage 3 and the turning off stage 4 in the first sub-frame, and details are not repeated here.

It should be noted that, in the circuit structure as shown in FIG. 10, the eighth transistor T8 adopts a P-type transistor, and the ninth transistor T9 adopts an N-type transistor, and the gate electrodes of both of them simultaneously receive the first selection control signal CK, thereby causing the eighth transistor T8 and the ninth transistor T9 to be respectively turned on in two different sub-frames. The embodiments of the present disclosure include, but are not limited to this, for example, in other some embodiments, the eighth transistor T8 can also adopt an N-type transistor, and the ninth transistor T9 can also adopt a P-type transistor. Accordingly, the gate electrodes of the eighth transistor T8 and the ninth transistor T9 simultaneously receive the second selection control signal CB (as shown by CB in FIG. 12A), and the eighth transistor T8 and the ninth transistor T9 can further be respectively turned on in two different sub-frames to complete the corresponding function.

Figure 11:
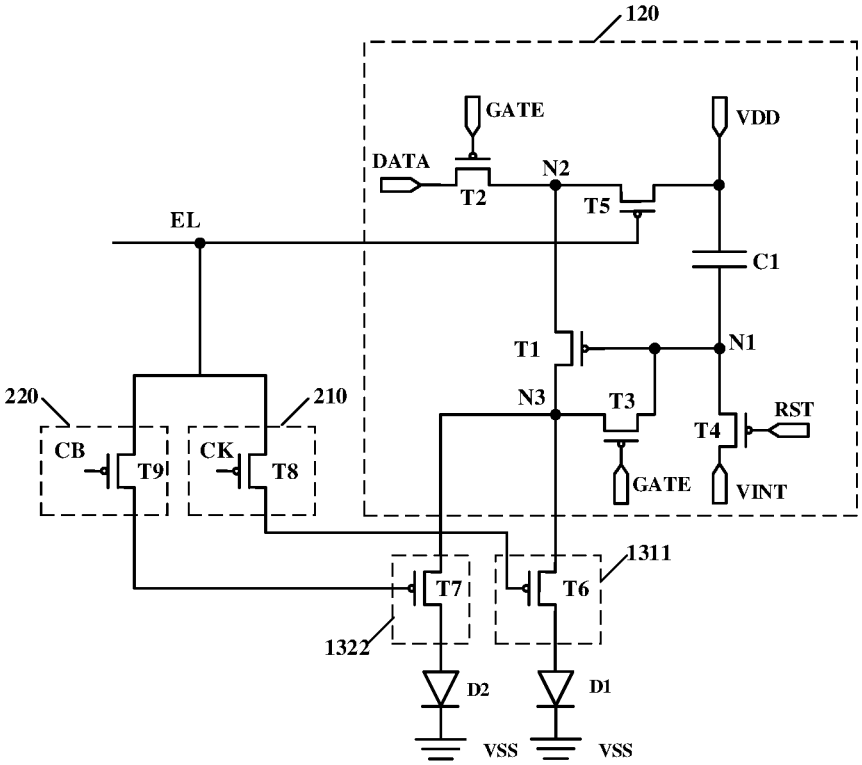
FIG. 11 is a circuit diagram of an implementation example of a pixel driving circuit, a selection circuit and a light-emitting circuit in another display panel provided by some embodiments of the present disclosure.

In some other embodiments of the present disclosure as shown in FIG. 11, the differences between this embodiment and the embodiment as shown in FIG. 10 includes that the eighth transistor T8 and the ninth transistor T9 each adopt a P-type transistor, the gate electrode of the eighth transistor T8 is configured to receive the first selection control signal CK, and the gate electrode of the ninth transistor T9 is configured to receive the second selection control signal CB.

The operation principle of the circuit structure as shown in FIG. 11 is described below in conjunction with a signal timing diagram as shown in FIG. 12A. For example, in the first sub-frame, because the first selection control signal CK is always kept at a low level, the eighth transistor T8 keeps being turned on in the first sub-frame. Because the second selection control signal CB is always kept at a high level, the ninth transistor T9 keeps being turned off in the first sub-frame. In the second sub-frame, because the first selection control signal CK is always kept at a high level, the eighth transistor T8 keeps being turned off in the second sub-frame. Because the second selection control signal CB is always kept at a low level, the ninth transistor T9 keeps being turned on in the second sub-frame. In the above manner, the eighth transistor T8 and the ninth transistor T9 can be turned on in the two sub-frames respectively, thereby completing a corresponding function of time-sharing display. It should be noted that, the operation principle of the pixel driving circuit 120 in each sub-frame is the same as the corresponding descriptions in the embodiment as shown in FIG. 10, and details are not described herein again.

It should be noted that, in the circuit structure as shown in FIG. 11, the eighth transistor T8 and the ninth transistor T9 can further adopt N-type transistors. Accordingly, the gate electrode of the eighth transistor T8 is configured to receive the second selection control signal CB, and the gate electrode of the ninth transistor T9 is configured to receive the first selection control signal CK.

Figure 12B:
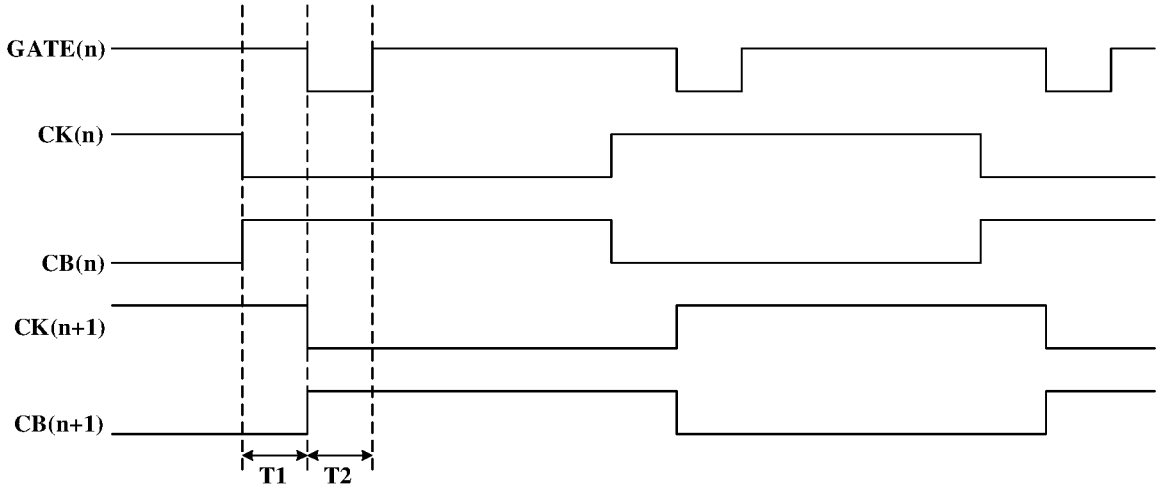
FIG. 12B is a signal timing diagram of selection control signals outputted by two adjacent stages of selection driving sub-circuits.

FIG. 12A only shows the first selection control signal CK and the second selection control signal CB applied to the selection circuit 200 of one row of the sub-pixel unit groups 100, and FIG. 12B shows a relationship between the first selection control signal and the second selection control signal applied to the selection circuit 200 of two adjacent rows of the sub-pixel unit groups 100. As shown in FIG. 12B, CK(n) represents a first selection control signal provided by an (n)th-stage selection driving sub-circuit 310 corresponding to an (n)th row of the sub-pixel unit groups 100, and CK(n+1) represents a first selection control signal provided by an (n+1)th-stage selection driving sub-circuit 310 corresponding to an (n+1)th row of the sub-pixel unit groups 100. For example, CK(n) and CK(n+1) can be shifted from each other by a fixed time interval T1, which can be, for example, a turn-on time T2 of the gate scanning signal provided by the gate driving circuit 500. CB(n) represents a second selection control signal provided by the (n)th-stage selection driving sub-circuit 310 corresponding to the (n)th row of the sub-pixel unit groups 100, and CB(n+1) represents a second selection control signal provided by the (n+1)th-stage selection driving sub-circuit 310 corresponding to the (n+1)th row of the sub-pixel unit groups 100. For example, CB(n) and CB(n+1) can be shifted from each other by the fixed time interval T1, which can be, for example, the turn-on time T2 of the gate scanning signal provided by the gate driving circuit 500. The following embodiments are the same as those described herein in this respect and will not be described again.

Figure 13:
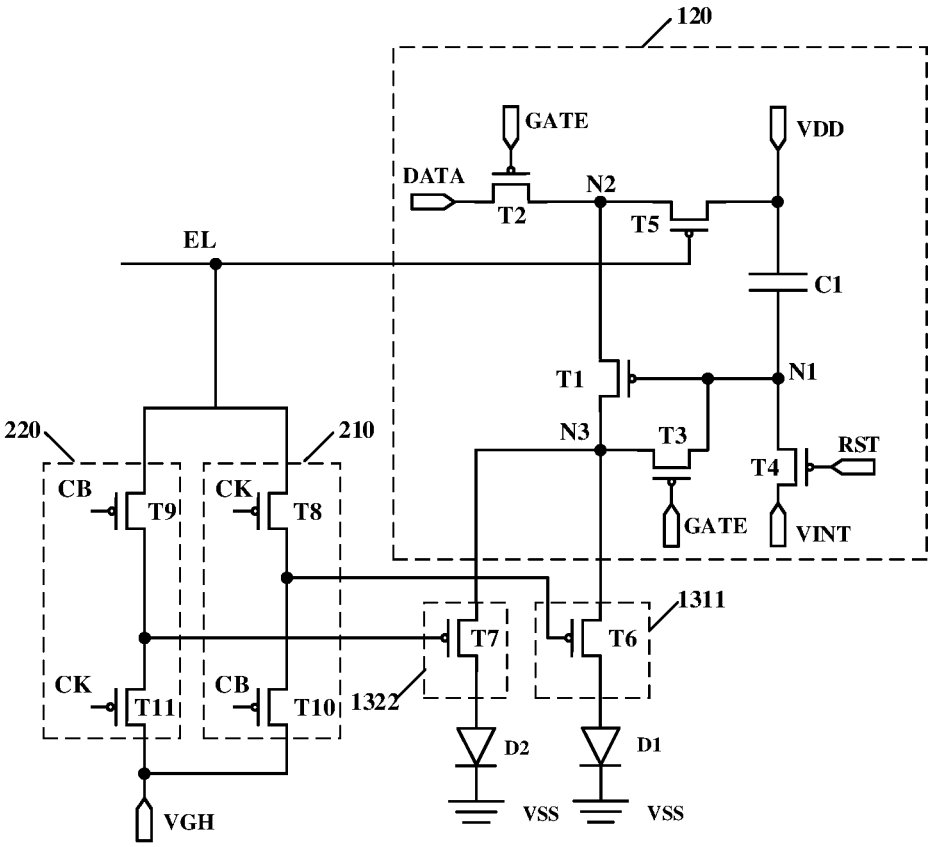
FIG. 13 is a circuit diagram of an implementation example of a pixel driving circuit, a selection circuit and a light-emitting circuit in yet another display panel provided by some embodiments of the present disclosure.

In some other embodiments of the present disclosure, as shown in FIG. 13, the differences between this embodiment and the embodiment as shown in FIG. 11 includes that the first selection sub-circuit 210 further includes a tenth transistor T10. A gate electrode of the tenth transistor T10 is configured to receive the second selection control signal CB, a first electrode of the tenth transistor T10 is connected to the second electrode of the eighth transistor T8, a second electrode of the tenth transistor T10 is connected to a third voltage terminal VGH to receive a third voltage; and the second selection sub-circuit 220 further includes an eleventh transistor T11, a gate electrode of the eleventh transistor T11 is configured to receive the first selection control signal CK, a first electrode of the eleventh transistor T11 is connected to the second electrode of the ninth transistor T9, and a second electrode of the eleventh transistor T11 is connected to the third voltage terminal VGH to receive the third voltage. For example, the third voltage is a high voltage, and the high voltage can cause the sixth transistor T6 and the seventh transistor T7 to be turned off.

Figure 14:
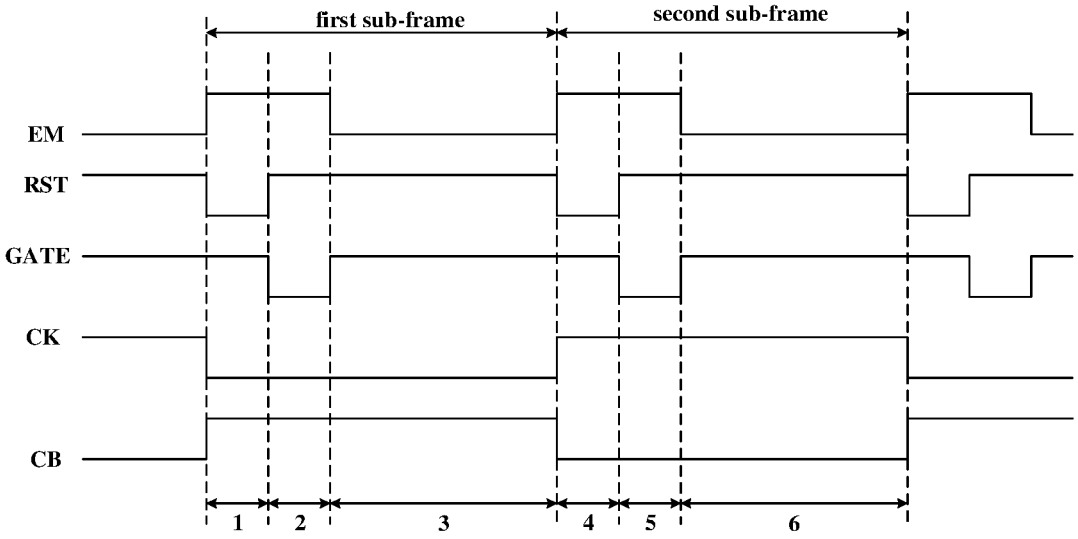
FIG. 14 is a signal timing diagram corresponding to FIG. 13.

Next, the operation principle of the circuit structure as shown in FIG. 13 is described below in combination with a signal timing diagram as shown in FIG. 14. For example, in the first sub-frame, because the first selection control signal CK is always kept at a low level, the eighth transistor T8 and the eleventh transistor T11 keep being turned on in the first sub-frame, the light-emitting control signal provided by the light-emitting control line EL can be applied to the gate electrode of the sixth transistor T6 through the eighth transistor T8, thereby causing the sixth transistor T6 to be turned on during the light-emitting stage. In addition, the third voltage (a high voltage) provided by the third voltage terminal VGH can be applied to the gate electrode of the seventh transistor T7 through the eleventh transistor T11, thereby causing the seventh transistor T7 to be turned off during the first sub-frame, and preventing the second light-emitting element D2 from emitting light during the first sub-frame, so as to avoid the occurrence of poor display. Further in the first sub-frame, because the second selection control signal CB is kept at a high level, the ninth transistor T9 and the tenth transistor T10 keep being turned off during the first sub-frame.

For example, in the second sub-frame, because the second selection control signal CB is always kept at a low level, the ninth transistor T9 and the tenth transistor T10 keep being turned on in the second sub-frame, and the light-emitting control signal provided by the light-emitting control line EL can be applied to the gate electrode of the seventh transistor T7 through the ninth transistor T9, thereby causing the seventh transistor T7 to be turned on during the light-emitting stage. In addition, the third voltage (a high voltage) provided by the third terminal voltage VGH is supplied to gate electrode of the sixth transistor T6 through the tenth transistor T10, thereby causing the sixth transistor T6 to be turned off during the second sub-frame, and preventing the first light-emitting element D1 from emitting light during the second sub-frame, so as to avoid the occurrence of poor display. Further in the second sub-frame, because the first selection control signal CK is kept at a high level, the eighth transistor T8 and the eleventh transistor T11 keep being turned off during the second sub-frame.

It should be noted that, the operation principle of pixel driving circuit 120 as shown in FIG. 13 in the resetting stage 1, the data writing and compensating stage 2, and the light-emitting stage 3 in the first sub-frame is the same as that of the embodiment as shown in FIG. 10. Similarly, the operation principle of the pixel driving circuit 120 as shown in FIG. 13 in in the resetting stage 4, the data writing and compensating stage 5, and the light-emitting stage 6 in the second sub-frame is the same as that of the embodiment as shown in FIG. 10, and details are not described again.

In the display panel provided by the embodiment of the present disclosure, by reusing the pixel driving circuit and disposing the selection circuit, the plurality of light-emitting circuits in the sub-pixel unit group can be provided with the light-emitting control signal in a time sharing manner to allow the plurality of light-emitting circuits to emit light in different sub-frames, and thus in a case where the amount of pixel driving circuits provided by the display panel is unchanged, more sub-pixel units can be provided corresponding to each pixel driving circuit, thereby increasing the resolution of the display panel.

Figure 15:
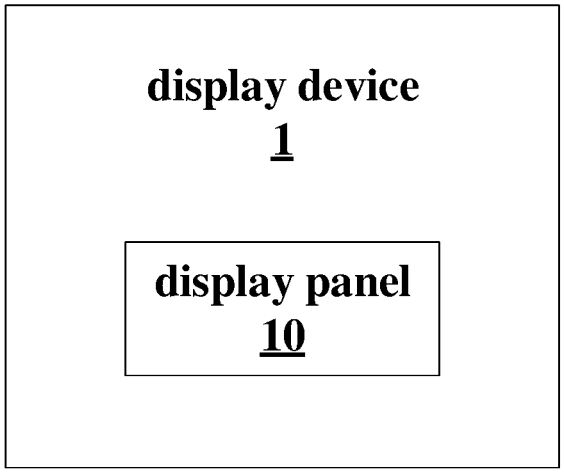
FIG. 15 is a schematic diagram of a display device provided by some embodiments of the present disclosure.
Figure 16:
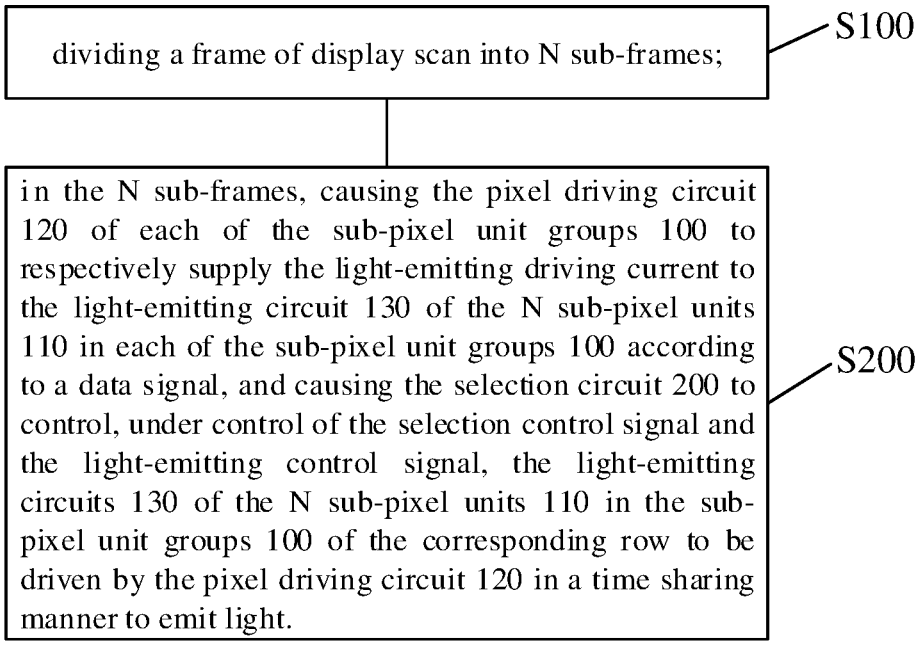
FIG. 16 is a schematic diagram of a driving method provided by some embodiments of the present disclosure.

The embodiments of the present disclosure further provide a display device 1, and as shown in FIG. 15, the display device 1 includes any display panel 10 provided by the embodiments of the present disclosure. For example, the display device 1 provided by the embodiments of the present disclosure can be a display, an OLED panel, an OLED television, a mobile phone, a tablet computer, a notebook computer, a digital photo frame, a navigator and other products or members having a display function. The display device provided by the embodiments of the present disclosure can increase the resolution of the display.

The embodiments of the present disclosure further provide a driving method that can be used to drive the display panel 10 and the display device 1 using the display panel 10 provided by the embodiments of the present disclosure. For example, the driving method includes the following operations.

Step S100: dividing a frame of display scan into N sub-frames;

Step S200: In the N sub-frames, causing the pixel driving circuit 120 of each of the sub-pixel unit groups 100 to respectively supply the light-emitting driving current to the light-emitting circuit 130 of the N sub-pixel units 110 in each of the sub-pixel unit groups 100 according to a data signal, and causing the selection circuit 200 to control, under control of the selection control signal and the light-emitting control signal, the light-emitting circuits 130 of the N sub-pixel units 110 in the sub-pixel unit groups 100 of the corresponding row to be driven by the pixel driving circuit 120 in a time sharing manner to emit light.

For example, for the display panel as shown in FIG. 3, in step S100, the frame of display scan can be divided into two sub-frames (for example, the first sub-frame and the second sub-frame), that is, N=2. Accordingly, in step S200, the light-emitting control signal is provided to the selection circuit 200 and the pixel driving circuit 120 through the light-emitting control line EL. The selection driving sub-circuit 310 provides the selection control signal (for example, the first selection control signal CK and the second selection control signal CB) to the selection circuit 200. The selection circuit 200 controls, under control of the selection control signal and the light-emitting control signal, light-emitting circuits 130 in two sub-pixel units 110 in the sub-pixel unit group 100 to be driven by the pixel driving circuit 120 to emit light respectively in the first sub-frame and the second sub-frame.

For example, in the case where the frame is divided into two sub-frames, light-emitting circuits 130 located in sub-pixel units 110 of odd-numbered rows and light-emitting circuits 130 located in sub-pixel units 110 of even-numbered rows emit light respectively in two different sub-frames.

It should be noted that, for the detailed descriptions and technical effects of the above-described driving method, reference can be made to the descriptions of the operation principle of the display panel 10 in the embodiments of the present disclosure, and details are not described here again.

What have been described above are only specific implementations of the present disclosure, the protection scope of the present disclosure is not limited thereto. The protection scope of the present disclosure should be based on the protection scope of the claims.

What is claimed is:

1. A display panel, comprising a plurality of sub-pixel unit groups arranged in an array, wherein the array comprises a plurality of rows and a plurality of columns, each of the sub-pixel unit groups comprises N sub-pixel units disposed along a column direction and a pixel driving circuit, each of the N sub-pixel units comprises a light-emitting circuit, the pixel driving circuit is electrically connected to the light-emitting circuits of the N sub-pixel units, and the pixel driving circuit is configured to provide light-emitting driving currents to the light-emitting circuits of the N sub-pixel units;

the display panel further comprises a selection circuit for each row of the sub-pixel unit groups and a light-emitting control line for each row of the sub-pixel unit groups, the selection circuit is electrically connected to the light-emitting control line and is electrically connected to the light-emitting circuits of the N sub-pixel units in the sub-pixel unit groups of a corresponding row, and the selection circuit is configured to control, under control of a light-emitting control signal provided by the light-emitting control line and a selection control signal, the light-emitting circuits of the N sub-pixel units in the sub-pixel unit groups of the corresponding row to be driven by the pixel driving circuit in a time sharing manner to emit light; and N is an integer greater than or equal to 2, wherein the pixel driving circuit comprises a light-emitting driving circuit, a data writing circuit, a compensating circuit, a resetting circuit, and a light-emitting control circuit;

the light-emitting driving circuit comprises a driving control terminal, a first terminal and a second terminal, and the light-emitting driving circuit is configured to control a light-emitting driving current running through the first terminal and the second terminal;

the data writing circuit is configured to write a data signal to the driving control terminal of the light-emitting driving circuit in response to a gate scanning signal;

the compensating circuit is configured to store the written data signal and compensate the light-emitting driving circuit in response to the gate scanning signal;

the resetting circuit is configured to apply a reset voltage to the driving control terminal of the light-emitting driving circuit in response to a reset signal; and the light-emitting control circuit is configured to apply a first voltage to the first terminal of the light-emitting driving circuit in response to the light-emitting control signal, wherein the light-emitting driving circuit comprises a first transistor, a gate electrode of the first transistor is used as the driving control terminal of the light-emitting driving circuit and is connected to a first node, a first electrode of the first transistor is used as the first terminal of the light-emitting driving circuit and is connected to a second node, and a second electrode of the first transistor is used as the second terminal of the light-emitting driving circuit and is connected to a third node;

the data writing circuit comprises a second transistor, a gate electrode of the second transistor is configured to be connected to a scanning signal terminal to receive the gate scanning signal, a first electrode of the second transistor is configured to be connected to a data signal terminal to receive the data signal, and a second electrode of the second transistor is connected to the second node;

the compensating circuit comprises a third transistor and a storage capacitor, a gate electrode of the third transistor is configured to be connected to the scanning signal terminal to receive the gate scanning signal, a first electrode of the third transistor is connected to the third node, a second electrode of the third transistor is connected to a first electrode of the storage capacitor, and a second electrode of the storage capacitor is configured to be connected to a first voltage terminal;

the resetting circuit comprises a fourth transistor, a gate electrode of the fourth transistor is configured to be connected to a reset control terminal to receive the reset signal, a first electrode of the fourth transistor is connected to the first node, and a second electrode of the fourth transistor is configured to be connected to a reset voltage terminal to receive the reset voltage; and the light-emitting control circuit comprises a fifth transistor, a gate electrode of the fifth transistor is configured to be connected to the light-emitting control line to receive the light-emitting control signal, a first electrode of the fifth transistor is configured to be connected to the first voltage terminal to receive the first voltage, and a second electrode of the fifth transistor is connected to the second node.

2. The display panel according to claim 1, wherein the selection circuit is electrically connected to light-emitting control terminals of the light-emitting circuits of the N sub-pixel units in the sub-pixel unit groups of the corresponding row, and the selection circuit is configured to apply in a time sharing manner the light-emitting control signal to the light-emitting control terminals of the light-emitting circuits of the N sub-pixel units in the sub-pixel unit groups of the corresponding row.

3. The display panel according to claim 2, further comprising a selection driving circuit, wherein the selection driving circuit comprises a plurality of cascaded selection driving sub-circuits, each row of the sub-pixel unit groups is provided with one of the selection driving sub-circuits, and the selection driving sub-circuit is configured to provide the selection control signal to the selection circuit corresponding to the sub-pixel unit groups of the corresponding row.

4. The display panel according to claim 3, further comprising a light-emitting control driving circuit, wherein the light-emitting control driving circuit comprises a plurality of cascaded light-emitting control driving sub-circuits, each row of the sub-pixel unit groups is provided with one of the light-emitting control driving sub-circuits, and the light-emitting control driving sub-circuit is electrically connected to the light-emitting control line corresponding to the sub-pixel unit groups of the corresponding row, and the light-emitting control driving sub-circuit is configured to provide the light-emitting control signal to the light-emitting control line.

5. The display panel according to claim 1, further comprising a selection driving circuit, wherein the selection driving circuit comprises a plurality of cascaded selection driving sub-circuits, each row of the sub-pixel unit groups is provided with one of the selection driving sub-circuits, and the selection driving sub-circuit is configured to provide the selection control signal to the selection circuit corresponding to the sub-pixel unit groups of the corresponding row.

6. The display panel according to claim 1, further comprising a light-emitting control driving circuit, wherein the light-emitting control driving circuit comprises a plurality of cascaded light-emitting control driving sub-circuits, each row of the sub-pixel unit groups is provided with one of the light-emitting control driving sub-circuits, and the light-emitting control driving sub-circuit is electrically connected to the light-emitting control line corresponding to the sub-pixel unit groups of the corresponding row, and the light-emitting control driving sub-circuit is configured to provide the light-emitting control signal to the light-emitting control line.

7. The display panel according to claim 1, further comprising a gate driving circuit, wherein the gate driving circuit comprises a plurality of cascaded shift register units, each row of the sub-pixel unit groups is provided with one of the shift register units, and the shift register unit is configured to provide a gate scanning signal to the pixel driving circuits in the sub-pixel unit groups of the corresponding row.

8. The display panel of claim 1, wherein N=2, two sub-pixel units in each of the sub-pixel unit groups respectively comprise a first light-emitting sub-circuit and a second light-emitting sub-circuit, the first light-emitting sub-circuit comprises a first switching circuit and a first light-emitting element, the second light-emitting sub-circuit comprises a second switching circuit and a second light-emitting element, and the first switching circuit and the second switching circuit are electrically connected to the second terminal of the light-emitting driving circuit.

9. The display panel according to claim 8, wherein the first switching circuit comprises a sixth transistor, a gate electrode of the sixth transistor is configured to receive the light-emitting control signal, a first electrode of the sixth transistor is connected to the second terminal of the light-emitting driving circuit, a second electrode of the sixth transistor is connected to a first electrode of the first light-emitting element, and a second electrode of the first light-emitting element is connected to a second voltage terminal to receive a second voltage; and the second switching circuit comprises a seventh transistor, a gate electrode of the seventh transistor is configured to receive the light-emitting control signal, a first electrode of the seventh transistor is connected to the second terminal of the light-emitting driving circuit, a second electrode of the seventh transistor is connected to a first electrode of the second light-emitting element, and a second electrode of the second light-emitting element is connected to the second voltage terminal to receive the second voltage.

10. The display panel according to claim 9, wherein the selection circuit comprises a first selection sub-circuit and a second selection sub-circuit, the first selection sub-circuit is electrically connected to the light-emitting control line and the first switching circuit, and the second selection sub-circuit is electrically connected to the light-emitting control line and the second switching circuit.

11. The display panel according to claim 10, wherein the selection control signal comprises a first selection control signal;

the first selection sub-circuit comprises an eighth transistor, a gate electrode of the eighth transistor is configured to receive the first selection control signal, a first electrode of the eighth transistor is electrically connected to the light-emitting control line, and a second electrode of the eighth transistor is electrically connected to the first switching circuit; and the second selection sub-circuit comprises a ninth transistor, a gate electrode of the ninth transistor is configured to receive the first selection control signal, a first electrode of the ninth transistor is electrically connected to the light-emitting control line, and a second electrode of the ninth transistor is electrically connected to the second switching circuit, wherein one of the eighth transistor and the ninth transistor is a P-type transistor, and a remaining one of the eighth transistor and the ninth transistor is an N-type transistor.

12. The display panel according to claim 8, wherein the selection circuit comprises a first selection sub-circuit and a second selection sub-circuit, the first selection sub-circuit is electrically connected to the light-emitting control line and the first switching circuit, and the second selection sub-circuit is electrically connected to the light-emitting control line and the second switching circuit.

13. The display panel according to claim 12, wherein the selection control signal comprises a first selection control signal;

the first selection sub-circuit comprises an eighth transistor, a gate electrode of the eighth transistor is configured to receive the first selection control signal, a first electrode of the eighth transistor is electrically connected to the light-emitting control line, and a second electrode of the eighth transistor is electrically connected to the first switching circuit; and the second selection sub-circuit comprises a ninth transistor, a gate electrode of the ninth transistor is configured to receive the first selection control signal, a first electrode of the ninth transistor is electrically connected to the light-emitting control line, and a second electrode of the ninth transistor is electrically connected to the second switching circuit, wherein one of the eighth transistor and the ninth transistor is a P-type transistor, and a remaining one of the eighth transistor and the ninth transistor is an N-type transistor.

14. The display panel according to claim 12, wherein the selection control signal comprises a first selection control signal and a second selection control signal;

the first selection sub-circuit comprises an eighth transistor, a gate electrode of the eighth transistor is configured to receive the first selection control signal, a first electrode of the eighth transistor is electrically connected to the light-emitting control line, and a second electrode of the eighth transistor is electrically connected to the first switching circuit; and the second selection sub-circuit comprises a ninth transistor, a gate electrode of the ninth transistor is configured to receive the second selection control signal, a first electrode of the ninth transistor is electrically connected to the light-emitting control line, and a second electrode of the ninth transistor is electrically connected to the second switching circuit.

15. The display panel according to claim 14, wherein the first selection sub-circuit further comprises a tenth transistor, a gate electrode of the tenth transistor is configured to receive the second selection control signal, a first electrode of the tenth transistor is connected to the second electrode of the eighth transistor, and a second electrode of the tenth transistor is connected to a third voltage terminal to receive a third voltage; and the second selection sub-circuit further comprises an eleventh transistor, a gate electrode of the eleventh transistor is configured to receive the first selection control signal, a first electrode of the eleventh transistor is connected to the second electrode of the ninth transistor, and a second electrode of the eleventh transistor is connected to the third voltage terminal to receive the third voltage.

16. A display device, comprising the display panel according to claim 1.

17. A method of driving the display panel according to claim 1, comprising:

dividing a frame of display scan into N sub-frames; and in the N sub-frames, causing the pixel driving circuit of each of the sub-pixel unit groups to respectively supply the light-emitting driving currents to the light-emitting circuits of the N sub-pixel units in each of the sub-pixel unit groups according to a data signal, and causing the selection circuit to control, under control of the selection control signal and the light-emitting control signal, the light-emitting circuits of the N sub-pixel units in the sub-pixel unit groups of the corresponding row to be driven by the pixel driving circuit in the time sharing manner to emit light.

18. The method according to claim 17, wherein N=2, and the light-emitting circuits located in the sub-pixel units of an odd-numbered row and the light-emitting circuits located in the sub-pixel units of an even-numbered row emit light respectively in two different sub-frames of the N sub-frames.

* * * * *